US005628091A

United States Patent [19]

Mueller

[11] Patent Number: 5,628,091

[45] Date of Patent: May 13, 1997

[54] BALLOON CLOSURE DEVICE

[76] Inventor: Herbert Mueller, Uekerstrasse 18, CH-5027 Herznach, Switzerland

[21] Appl. No.: 585,270

[22] Filed: Jan. 11, 1996

[30] Foreign Application Priority Data

Jan. 8, 1996 [CH] Switzerland ..... 32/96

[51] Int. Cl.[6] ..... A47B 96/06; A63B 41/04

[52] U.S. Cl. ..... 24/3.2; 24/30.55; 24/129 B; 24/30.5 L; 446/222

[58] Field of Search ..... 24/3.2, 30.5 L, 24/30.5 S, 30.5 R, 30.5 P, 129 R, 129 B, 570, 30, 28; 446/222, 220

[56] References Cited

U.S. PATENT DOCUMENTS

| | | | |
|---|---|---|---|
| 1,680,318 | 8/1928 | Callahan | 446/222 |
| 2,112,477 | 3/1938 | Brownfield | 24/30.5 S X |
| 2,396,906 | 3/1946 | Windson | 24/30.5 S X |
| 3,154,050 | 10/1964 | Hanson | 446/222 X |
| 3,720,991 | 3/1973 | Allison et al. | 29/211 D |
| 3,780,419 | 12/1973 | Allison et al. | 29/451 |
| 3,783,551 | 1/1974 | Allison et al. | 46/90 |
| 3,820,200 | 6/1974 | Myers | 24/30.5 S |
| 4,292,714 | 10/1981 | Walker | 24/30.5 S X |
| 4,729,749 | 3/1988 | Milne | 446/222 |
| 4,837,059 | 6/1989 | Milne | 428/12 |
| 4,936,532 | 6/1990 | Williams | 24/30.5 S X |
| 5,210,911 | 5/1993 | Brown et al. | 24/129 B X |
| 5,547,413 | 8/1996 | Murray | 446/222 X |

FOREIGN PATENT DOCUMENTS

| | | | |
|---|---|---|---|
| 2521433 | 8/1983 | France | F16B 2/06 |
| 2588478 | 4/1987 | France | 446/222 |
| 2093709 | 9/1982 | United Kingdom | A63H 27/10 |

*Primary Examiner*—Peter M. Cuomo
*Assistant Examiner*—Robert J. Sandy

[57] ABSTRACT

The balloon closure device of the present invention includes an integrally formed flat seal portion and removable tab portion (made of biodegradable material) and a loop of string or other type of line. The loop of string may be wrapped neatly around the tab portion, which eases handling of the device before it is used to seal a balloon. Once the device is used to seal a balloon, the loop of string may be used to secure the sealed balloon to the user's wrist without requiring the user to tie a knot.

15 Claims, 2 Drawing Sheets

BALLOON CLOSURE DEVICE

BACKGROUND OF THE INVENTION

The present invention relates to a device for sealing balloons after inflation. Conventional balloon closure devices are often made, at least partially, of materials that are neither biodegradable nor recycled and some include an integral means, usually a string or ribbon, for securing the balloon to another object. However, the securing means of conventional balloon closure devices typically have two loose ends that may tangle before the devices are used to seal a balloon. Thus, conventional balloon closure devices are often difficult to handle before they are used to seal a balloon. Moreover, to secure a balloon sealed with a conventional balloon closure device to one's wrist, requires that at least one of the loose ends be tied around the wrist. If only one loose end is tied around the wrist, the other loose end is still free to tangle around objects or otherwise interfere with the wearer's enjoyment of the balloon. Once tied, the balloon may be difficult to remove from the wrist.

SUMMARY OF THE INVENTION

Balloon closure devices according to the present invention feature a seal portion that contains a small opening, a looped string or other type of line threaded through the opening, and a removable tab portion. The tab portion acts as a reel around which the string may be wrapped during manufacture for convenient shipping and handling before the device is used to seal a balloon. Because the looped string is wrapped around the tab portion and then inserted through the opening in the seal portion, the user must remove the tab portion before the string may be unwrapped.

The seal portion is preferably flat and circular and connects integrally with a tab portion that is preferably substantially coplanar, flat, and rectangular. Accordingly, the seal and tab portions may be conventionally cut in one step from paperboard, cardboard, or other biodegradable materials. The materials of which the seal and tab portions are made may also be recycled material.

To seal a balloon, the user inserts the throat of the inflated balloon through the loop in the string that extends from one face of the seal portion, and pulls the loop extending from the opposite face of the seal portion until the string secures the balloon throat against the opening in the sealed portion so that the throat of the balloon is preferably pulled partially into the opening. The tab portion may be tom away from the seal portion if desired, either before or after the sealing operation. After the tab portion is torn away, the user may unwrap the string from the tab portion.

The balloon closure device (whether it is sealing a balloon or not) may be secured to or loosened from the user's wrist quickly and easily by wrapping the loop of string once around the wrist and inserting the seal, with or without a balloon attached, through the loop in the string. Alternatively, the user can secure the balloon by folding the loop of string, reaching through the loop, and grasping the length of string on the other side of the loop.

It is therefore an object of the present invention to provide a balloon closure device that is environmentally friendly because it is made of biodegradable materials.

It is a further object of the present invention to provide a balloon closure device that includes a removable means for tightly, neatly, compactly, and conveniently storing a string or other type of line until the user wants to secure the balloon to another object.

It is still a further object of the present invention to provide a balloon closure device that includes integral means to allow the sealed balloon to be quickly and easily secured to and loosened from the user's wrist or another object.

Other objects, features, and advantages of the present invention will become apparent with reference to the remainder of this document.

DETAILED DESCRIPTION OF THE DRAWINGS

Figure 1:
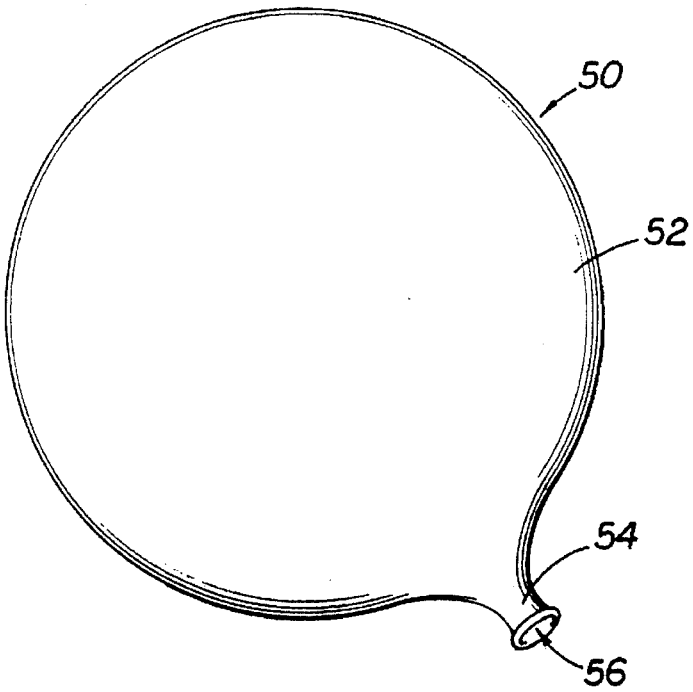
FIG. 1. is a perspective view of an inflated, but unsealed balloon.
Figure 2:
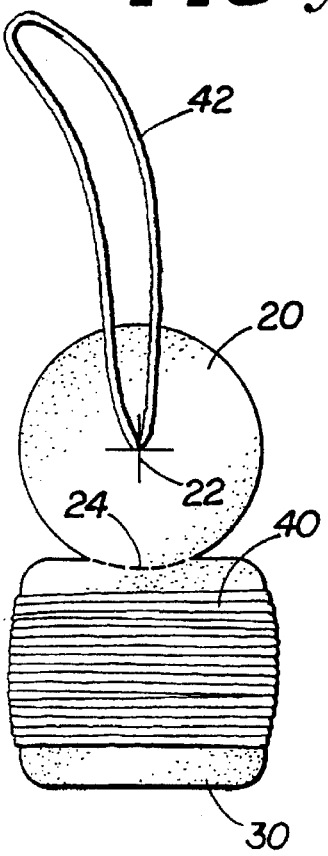
FIG. 2 is a plan view of a preferred embodiment of the balloon closure device of the present invention in which the string is wrapped around the tab portion.

FIG. 1 is a perspective view of an inflated, but unsealed balloon 10. Balloon 10 has body portion 52 for containing air or other fluid within the balloon, throat portion 54, and inflation opening 56 that is defined by throat portion 54. FIG. 2 is a plan view of an embodiment of balloon closure device 10 according to the present invention. Balloon closure device 10 has loop of material 40 (for example a loop of string, ribbon, or some other type of line) that is pulled through seal opening 22 in seal portion 20 so that loop 42 of material 40 protrudes from one face (not visible) of seal portion 20. Loop 44 of material 40 protrudes from the opposite face 26 of seal portion 20 through seal opening 22, and is shown wrapped around tab portion 30. As shown in FIG. 2, loop 44 of material 40 is stored in a compact manner to enable balloon closure device 10 to be handled easily during manufacture, shipment, sale, and use by the end user. With material 40 wrapped around tab portion 30, balloon closure device 10 occupies about half the space of conventional balloon closure devices.

Figure 2A:
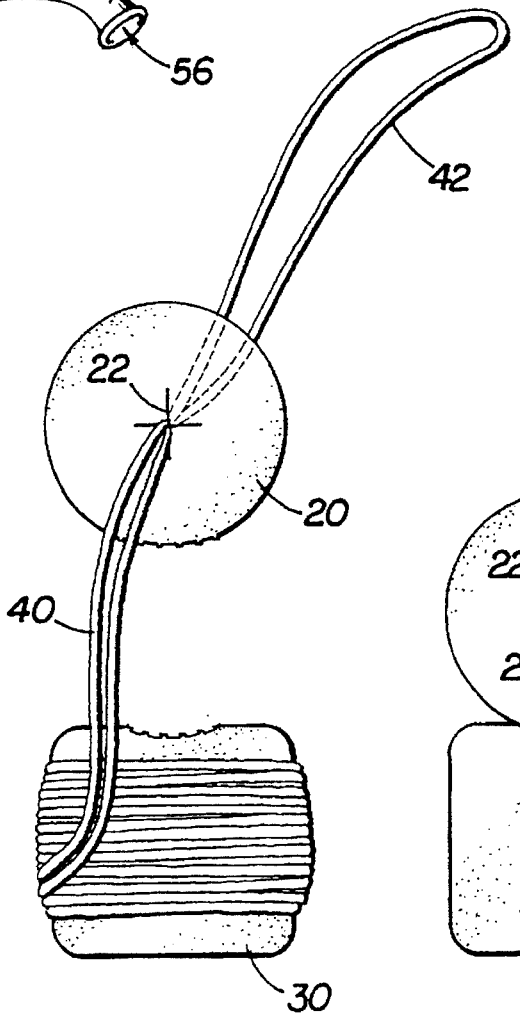
FIG. 2*a* is a plan view of the balloon closure device shown in FIG. 2, but with the tab portion removed from the seal portion and the string still wrapped around the tab portion.

FIG. 2*a* illustrates balloon closure device 10 in which tab portion 30 has been removed from seal portion 20, but material 40 remains wrapped around tab portion 30. In one embodiment, material 40 may only be unwrapped from tab portion 30 when it is separated from seal portion 20 because material 40 is wrapped with its end adjacent tab portion 30 and the remainder of material 40 wrapped on top of itself.

Such an arrangement offers the advantage of firmly securing material 40 to tab portion 30.

Figure 4:
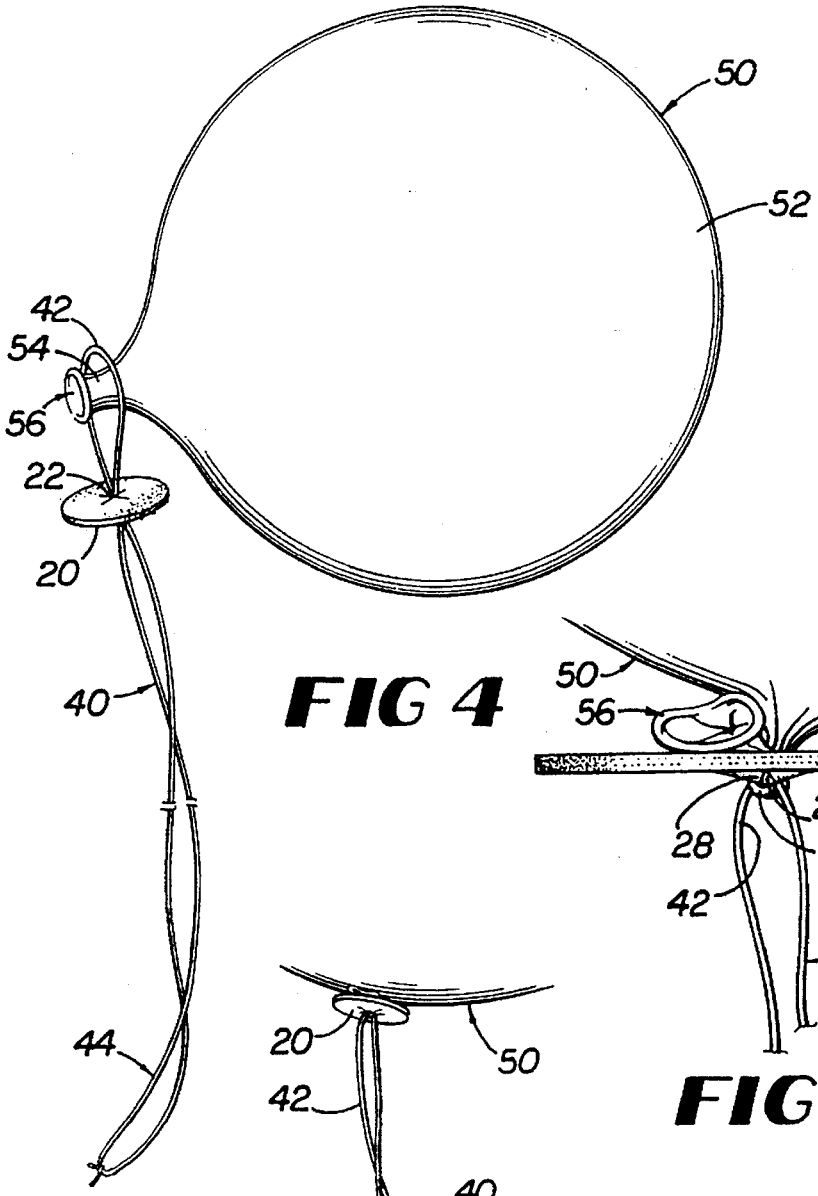
FIG. 4 is a perspective view of the balloon closure device of the present invention in which the tab portion has been removed, the string has been unwrapped, and the throat of an inflated, but unsealed, balloon is located within the loop of the string.
Figure 5:
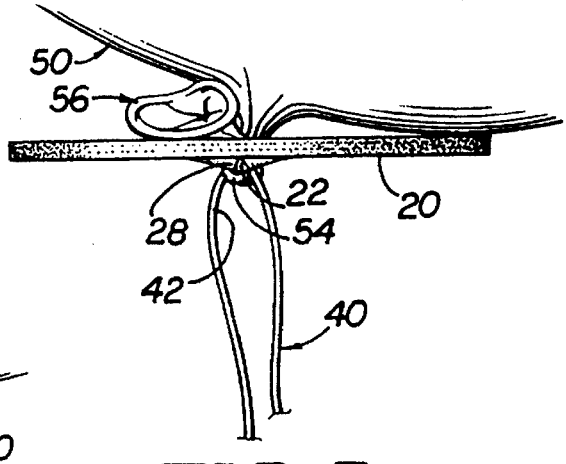
FIG. 5 is a detailed perspective view of the balloon closure device shown in FIG. 4 in which the inflation opening in the balloon has been sealed by pulling the string entirely through the opening in the seal portion.

When it is separated from seal portion 20, tab portion 30 may be used as a handle with which the user can pull loop 42 through seal opening 22 to seal a balloon (as described more fully in connection with FIGS. 4 and 5). When so used as a handle, tab portion 30 acts a lever that makes it easier for the user to pull throat 54 into seal opening 22. Tab portion 30 also protects the user's fingers from the potentially uncomfortable pressure that might exist if the user were to wrap material 40 around a finger and exert the force required to pull material 40 and throat 54 through opening 22.

Figure 3:
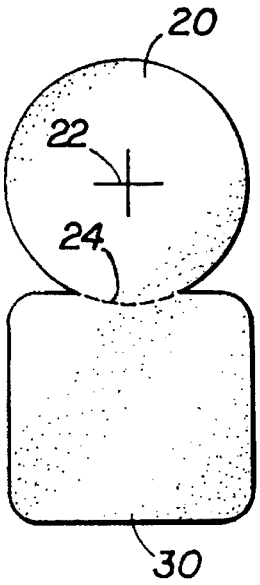
FIG. 3 is a plan view of the balloon closure device of FIG. 2 in which the string is completely removed.

FIG. 3 depicts balloon closure device 10 as shown in FIG. 2, but with material 40 unwrapped from tab portion 30 and completely removed from balloon closure device 10. Also apparent is perforation 24 that enables tab portion 30 to be easily torn away from seal portion 20. With tab portion 30 removed, balloon closure device 10 assumes the pleasingly symmetric circular shape of seal portion 20.

FIG. 4 depicts loop 42 surrounding throat 54 of inflated, but unsealed, balloon 50. To seal balloon 50, the user pulls material 40 until pulling loop 42 and part of throat 54 through seal opening 22 in seal portion 20. The user may also tear tab portion 30 away from seal portion 20 and use tab portion 30 as a handle to pull material 40 through seal opening 22. Tab portion 30 may (as shown in FIGS. 4 and 5), but need not, be removed from seal portion 20 for the user to seal balloon 50. A balloon 50 that is sealed as described above by balloon closure device 10 is shown in FIG. 5.

Seal opening 22 is preferably a pair of perpendicular slits of about the same length as shown in FIGS. 2–3. Alternatively, seal opening 22 may be a pair of perpendicular slits (or a single slit) with an aperture that is symmetrical about the intersection of the slits (or the center of the single slit) and having a maximum width smaller than the length of the slit(s) and larger than the minimum cross-sectional width of material 40. Seal openings 22 having such an aperture allow loop of material 40 to be more easily pulled through seal opening 22. Seal opening 22 may also be an aperture without slits (e.g., a circular or square hole). All types of seal openings 22 must be small enough to (i) seal inflation opening 56 when throat 54 is drawn into seal opening 22 and (ii) prevent throat 54 from easily being pulled out of seal opening 22.

When seal opening 22 consists of the pair perpendicular slits best shown in FIGS. 2–3 (or any other arrangement employing slits, even those using slits combined with an aperture), pulling throat 54 into seal opening 22 causes the slits to separate and the part of seal portion 20 immediately surrounding seal opening 22 to bulge in the direction in which throat 54 was pulled. This bulging action creates prongs 28 (e.g., four prongs 28 are present in the two-slit embodiment shown in FIGS. 2–6). Because the slits separate as described when throat 54 is pulled into seal opening 22, the slits make pulling throat 54 into seal opening easier than it would be if seal opening 22 did not include slits. Additionally, once throat 54 has been pulled into seal opening 22, prongs 28 prevent throat 54 from easily being pulled back out of seal opening 22. However, balloon closure device 10 is made of material that is thick and pliable enough that prongs 28 do not present sharp edges or points, which might cut throat 54 after balloon 50 is sealed.

Figure 6:
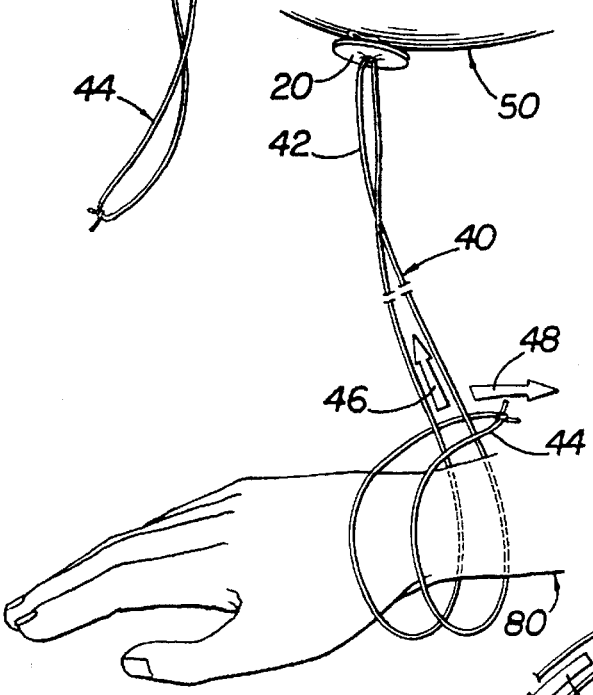
FIG. 6 is a perspective view of a balloon sealed with the balloon closure device of the present invention that illustrates one way in which a seal lloon may be secured to and loosened from a wrist or other object.

FIG. 6 illustrates the ease with which a user can secure a sealed balloon to his wrist or any other desired and appropriate object (or loosen material 40 to remove sealed balloon 50 from his wrist). As shown in FIG. 4, before the user seals balloon 50 by pulling loop 42 through seal opening 22, material 40 may be described as having two loops 42 and 44, one on each side of seal opening 22. After the user seals balloon 50 by pulling loop 42 entirely through seal opening 22, material 40 consists of essentially a single loop. Sealed balloon 50 may be secured to wrist 80 by simply inserting sealed balloon 50 in direction 46 through the portion of material 40 identified as loop 44 and continuing to pull sealed balloon 50 in direction 46 until material 40 tightens around wrist 80. Once secured to wrist 80, the user can loosen material 40 by pulling loop 44 in direction 48. Alternatively, the user can secure balloon closure device 10 to wrist 80 by inserting balloon closure device 10 through loop 44 before balloon 50 is sealed.

Figure 7:
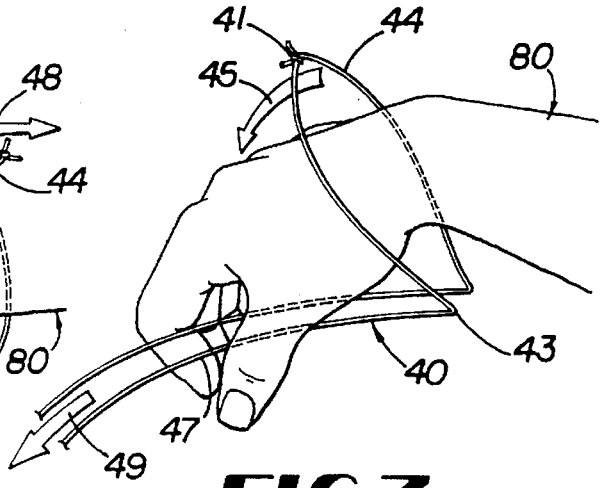
FIG. 7. is a perspective view of a balloon sealed with the balloon closure device of the present invention that illustrates an alternative way in which a sealed balloon may be secured to and loosened from a wrist.

Another alternative method of securing loop 44 to wrist 80 involves folding loop 44 as shown in FIG. 7. The user inserts wrist 80 in direction 49 through loop 44 near apex 41 and grasps material 40 at location 47. Material 40 is pulled in direction 49 so that material 40 slides through the user's hand until loop 44 tightens around wrist 80. To loosen material 40 from wrist 80, the user need only release his grasp around material 40 and pull wrist 80 out of loop 44. All methods of using balloon closure device 10 to secure a sealed balloon to another object are more convenient, faster, and easier to loosen than methods requiring the user to tie a loose end around the other object.

Although not necessary to enable balloon closure device 10 to seal a balloon, balloon closure device 10 is preferably made exclusively of biodegradable materials so that it does not pose a solid waste hazard when discarded. For example, seal portion 20 and tab portion 30 are preferably made in one piece of biodegradable paperboard, cardboard, or some other product of suitable stiffness. Material 40 is preferably a string or ribbon made of a natural fiber (e.g., cotton) or a similarly biodegradable material. To further lessen the burden that balloon closure device 10 could place on the environment, seal portion 20, tab portion 30, and material 40 could be made of recycled materials.

The foregoing is provided for the purposes of description rather than limitation. Changes, modifications, or adaptations may be made to the balloon closure device and components described in the foregoing and the remainder of this document without departing from the scope or spirit of the invention.

I claim:

1. A balloon closure device made entirely of biodegradable materials for sealing a balloon, which balloon comprises a body portion with an interior connected to a throat portion defining an inflation opening that connects the interior to the atmosphere outside the balloon, comprising:

a. a seal portion with a center comprising:
   i. a seal opening and
   ii. a seal surface;

b. a loop of material that is threaded through and adapted to draw the throat portion of the balloon into the seal opening such that the seal portion tightly seals the inflation opening;

c. a tab portion that is:
   i. connected to the seal portion,
   ii. adapted to act as a reel for the loop of material, and
   iii. adapted to be removed from the seal portion.

2. A balloon closure device according to claim 1 in which the seal opening comprises a slit that is substantially symmetrical about the center of the seal portion.

3. A balloon closure device according to claim 2 in which the seal portion and the tab portion are made of paperboard.

4. A balloon closure device according to claim 3 further comprising scoring along a line defined by the interface between the seal portion and the tab portion.

5. A balloon closure device according to claim 4 in which the loop of material is made of string.

6. A balloon closure device according to claim 4 in which the loop of material is made of ribbon.

7. A balloon closure device according to claim 4 in which:

a. the slit has a length, b. the loop of material has a minimum cross-sectional width, and c. the seal opening further comprises an aperture that:

i. has a maximum aperture width that is:

A. smaller than the length of the slit and

B. at least as large as about the minimum cross-sectional width of the loop of material and ii. is approximately symmetric about the center of the seal portion.

8. A method for sealing and securing to another object a balloon, which balloon comprises an interior and a throat defining an inflation opening that communicates between the interior and the external atmosphere, and which method uses a balloon closure device comprising a seal portion, a seal opening extending through the seal portion, a continuous loop of material that is threaded through the seal opening to create first and second loops on opposite sides of the seal portion, comprising the steps of:

a. inserting the throat through the first loop;

b. drawing the throat at least partially into the seal opening but not completely through the seal opening by pulling on the second loop;

c. wrapping the loop of material around the object to which the balloon is to be secured;

d. inserting the balloon through the second loop to form a third loop;

e. pulling the balloon and the loop of material through the second loop until the third loop tightens around the object.

9. The method of claim 8 in which a. the balloon closure device used in the method further comprises a removable tab portion connected to the seal portion and around which the second loop may be wrapped and b. the method further comprises the step of removing the tab portion from the seal portion after the throat is inserted through the first loop.

10. A balloon closure device made entirely of biodegradable materials for sealing a balloon, which balloon comprises an interior portion for holding air or other fluid and a throat through which an inflation opening communicates with the external atmosphere and the interior, comprising:

a. a flat, substantially circular seal portion having a first face and a second face;

b. a seal opening located at about the center of the seal portion and extending through the seal portion comprising a slit that is substantially symmetrical about the center of the seal portion; and c. a continuous loop of material that is treaded through the seal opening so that a first loop protrudes from the first face of the seal portion and a second loop protrudes from the second face, d. a removable, flat, generally rectangular tab portion that is integrally formed with and connected to the seal portion and acts as a reel for the second loop;

e. a perforation along a line defined by the interface between the seal portion and the tab portion that is adapted to facilitate the removal of the tab portion from the seal portion;

whereby the balloon may be sealed by inserting the throat of the inflated, but unsealed, balloon into the first loop and pulling the second loop until the throat is at least partially, but not completely drawn through the seal opening so that a portion of the throat protrudes from the second face of the seal portion.

11. A balloon closure device according to claim 10 in which the loop of material is made of string.

12. A balloon closure device according to claim 10 in which the loop of material is made of ribbon.

13. A balloon closure device according to claim 10 in which:

a. the slit has a length, b. the loop of material has a minimum cross-sectional width, and c. the seal opening further comprises an aperture that:

i. has a maximum aperture width that is:

A. smaller than the length of the slit and

B. at least as large as about the minimum cross-sectional width of the loop of material and ii. is approximately symmetric about the center of the seal portion.

14. A method for sealing and securing to a wrist a balloon, which balloon comprises an interior and a throat defining an inflation opening that communicates between the interior and the external atmosphere, and which method uses a balloon closure device comprising a seal portion, a seal opening extending through the seal portion, a continuous loop of material that is threaded through the seal opening to create a first loop and a second loop with an apex, which first and second loops are on opposite sides of the seal portion, comprising the steps of:

a. inserting the throat through the first loop;

b. drawing the throat at least partially into the seal opening but not completely through the seal opening by pulling on the second loop;

c. folding the second loop once at a fold point;

d. inserting the wrist through the second loop near the apex; and e. grasping the second loop on the portion of the second loop opposite the fold point from the apex.

15. The method of claim 14 in which a. the balloon closure device used in the method further comprises a removable tab portion connected to the seal portion and around which the second loop may be wrapped and b. the method further comprises the step of removing the tab portion from the seal portion after the throat is inserted through the first loop.

* * * * *